US006250608B1

(12) United States Patent
Ridley

(10) Patent No.: US 6,250,608 B1
(45) **Date of Patent: *Jun. 26, 2001**

(54) ROTATABLE HITCH FOR SECURING A LIFT SHEAVE TO A FRAME ELEMENT

(75) Inventor: Steven J. Ridley, Glen Alpine (AU)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,557

(22) Filed: Feb. 17, 1999

(30) Foreign Application Priority Data

Mar. 4, 1998 (AT) ..... PP2122

(51) Int. Cl.[7] ..... B66D 3/04

(52) U.S. Cl. ..... 254/415; 403/164; 411/389

(58) Field of Search ..... 254/413, 415; 403/164, 165; 411/389, 383, 395; 294/82.1, 82.15

(56) References Cited

U.S. PATENT DOCUMENTS

| | | | | |
|---|---|---|---|---|
| 3,046,056 | * | 7/1962 | Greene et al. | 403/164 |
| 3,406,605 | * | 10/1968 | Kviten | 411/389 |
| 3,786,935 | | 1/1974 | Vlazny, et al. | 212/11 |
| 4,403,766 | | 9/1983 | Schmeider | 254/399 |
| 4,889,458 | * | 12/1989 | Taylor | 411/383 |
| 5,286,130 | * | 2/1994 | Mueller | 403/165 |
| 5,564,530 | | 10/1996 | Iwakiri, et al. | 187/411 |
| 5,690,456 | * | 11/1997 | Wedellsborg | 411/383 |

FOREIGN PATENT DOCUMENTS 0 639 526 A2 8/1994 (EP) .

* cited by examiner

*Primary Examiner*—Katherine A. Matecki

(57) ABSTRACT

A rotatable hitch (30) is secured to crosshead channels (10) on an overhead sheave (40) and includes a sleeve (50) and a connecting rod (60) disposed within the sleeve (50).

14 Claims, 3 Drawing Sheets

ROTATABLE HITCH FOR SECURING A LIFT SHEAVE TO A FRAME ELEMENT

TECHINICAL FIELD

This invention relates to a rotatable hitch for securing a lift sheave to a frame element.

BACKGROUND OF THE INVENTION lift sheaves are pivotally connected to a frame element which may comprise car frame cross-head channels connected to a lift car or an overhead beam fixed in a lift well to facilitate movement of the lift car in the lift well. The rotatable hitch allows the lift sheave to be oriented into a desired orientation relative to the frame member during installation and also allows a very slight amount of rotation of the lift sheave relative to the frame elements during use, dependent upon the load applied by a cable as the cable is wound onto and wound off the lift sheave, particularly at the extremities of the movement of the lift car. This angle of movement may be as small as 1°. Some Government regulations also require the rotatable hitch to be secured at two locations to provide for failsafe connection in the event that one of the couplings of the sheave fails during use of the lift.

DISCLOSURE OF THE INVENTION

The object of the present invention is to provide rotatable hitch which meets these objectives. The invention in a first aspect may be said to reside in a rotatable hitch for securing a lift sheave to a frame element, including: a hollow sleeve; first coupling means attached to the hollow sleeve for coupling the hollow sleeve to the lift sheave; second coupling means attached to the hollow sleeve for coupling the hollow sleeve to the frame element; a connecting rod arranged within the hollow sleeve; third coupling means attached to the connecting rod for coupling the connecting rod to the lift sheave; fourth coupling means attached to the connect rod for coupling the connecting rod to the frame element and the hollow sleeve being rotatable relative to the frame element and/or lift sheave when installed between the lift sheave and the frame element to enable rotation of the lift sheave relative to the frame element.

In one embodiment the first and second coupling means comprise nuts on the hollow sleeve for engaging an abutment member on the lift sheave and frame element respectively, the nuts engaging the abutment members and abutting the abutment members so as to secure the hitch to the lift sheave and the frame element.

In another embodiment, the first coupling means may comprise a screw-thread on the lift sheave or frame element and a cooperating screw-thread on the hollow sleeve for engaging the screw-thread on the lift sheave or frame element.

Preferably the third and fourth coupling means also comprise nuts on the connecting rod, the nuts engaging a retaining plate and sandwiching the retaining plate between the respective nut and respective ends of the hollow sleeve.

Preferably the retaining plates comprise washers. Preferably the lift sheave includes a pair of brackets which support a connecting plate, the connecting plate having a hole and the hollow sleeve passing through the hole to pivotally couple the lift sheave to the frame element.

The invention may also be said to reside in a lift system including: a lift sheave having a support member; a frame element having a support member; a hole in at least one of the support members of the lift sheave or frame element; a hollow sleeve extending through the hole in the support member so that a free end of the hollow sleeve project through the hole;

a first coupling member on the free end of the hollow sleeve for preventing the hollow sleeve from being withdrawn through the hole and for coupling the sleeve to the lift sheave or frame element which has the hole;

a second coupling member on the other free end of the hollow sleeve for coupling the sleeve to the other of the lift sheave or frame element;

the sleeve being rotatable in the hole so as to enable the lift sheave to rotate relative to the frame element;

a connecting rod within the hollow sleeve; third coupling means at one end of the connecting rod for coupling the connecting rod to the lift sheave; and fourth coupling means at the other end of the connecting rod for coupling the connecting rod to the frame element.

In one embodiment, the both of the support members of the lift sheave and frame element have a said hole and the hollow sleeve extends through each of the holes in the support members to that both free ends of the hollow sleeve project through the support members, the first and second coupling members comprise nuts on the hollow sleeve for engaging the support members on the lift sheave and frame element respectively, the nuts abutting the support members so as to connect the hitch to the lift sheave and the frame element.

In this embodiment of the invention, the support members comprise abutment plates against which the nuts abut to couple the hollow sleeve to the lift sheave and frame element.

In another embodiment of the invention, one free end of the hollow sleeve can be secured to the support member of the other of the lift sheave or frame element so as to be a substantially rigid connection.

In this arrangement, the substantially rigid connection can be formed by a screw-thread in a hole in the support member and a cooperating screw-thread on the free end of the hollow sleeve so that the hollow sleeve is screwed into the hole to couple the hollow sleeve to the support member and therefore the other of the lift sheave or frame element.

Preferably the third and fourth coupling members comprise nuts on the connecting rod, the nuts engaging respective retaining plates and locating the retaining plate between the respective nut and respective ends of the hollow sleeve.

Preferably the retaining plates comprise washers.

Preferably the lift sheave includes lift sheave brackets and the support member of the lift sheave comprises a connecting plate connected between the lift sheave brackets.

Preferably the support member of the frame element comprises a plate connected to the frame element.

Preferred embodiments of the invention will be described, by way of example, with reference to the accompanying drawings in which:

BEST MODE FOR CARRYING OUT THE INVENTION

Figure 1:
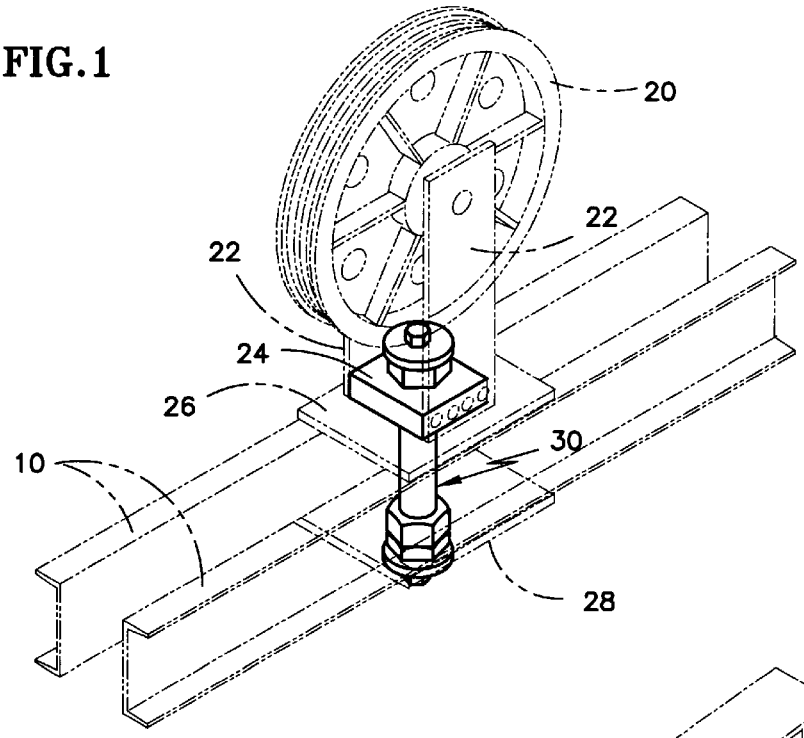
FIG. 1 is a view of a rotatable hitch applicable to a car frame of a lift system.

With reference to FIG. 1, a pair of car frame cross-head channels 10 are coupled to a lift car (not shown). A lift sheave 20 is connected to the cross-head channels 10 by a rotatable hitch 30 according to one embodiment of the invention.

The lift sheave 20 includes a pair of lift sheave brackets 22 which support a connecting abutment plate 24. Top and bottom plates 26 and 28 are secured to the cross-head channels 10 and the hitch 30 passes through holes in the plates 26 and 28 as well as a hole in the connecting plate 24.

Figure 2:
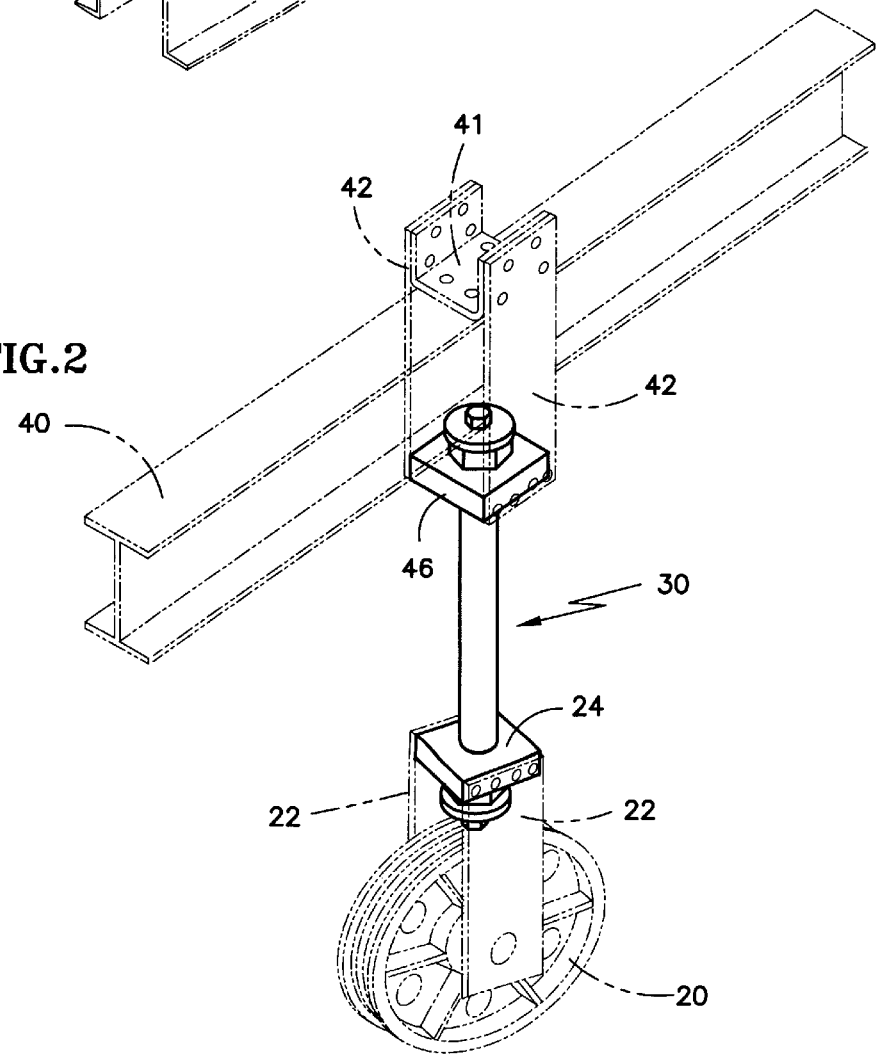
FIG. 2 is a view of a rotatable hitch according to an embodiment of the invention applicable to an overhead suspended sheave of a lift system.

In the embodiment of FIG. 2. a fixed overhead beam 40 is secured in a lift well and includes a connecting plate 42 which supports top brackets 41 which in turn support a connecting plate 46. A sheave 20 is supported below the overhead beam 40 by a rotatable hitch 30 which is substantially the same as the hitch 30 described with reference to FIG. 1. As in FIG. 1, the sheave 20 includes brackets 22 and a connecting plate 24 between the brackets 22.

Figure 3:
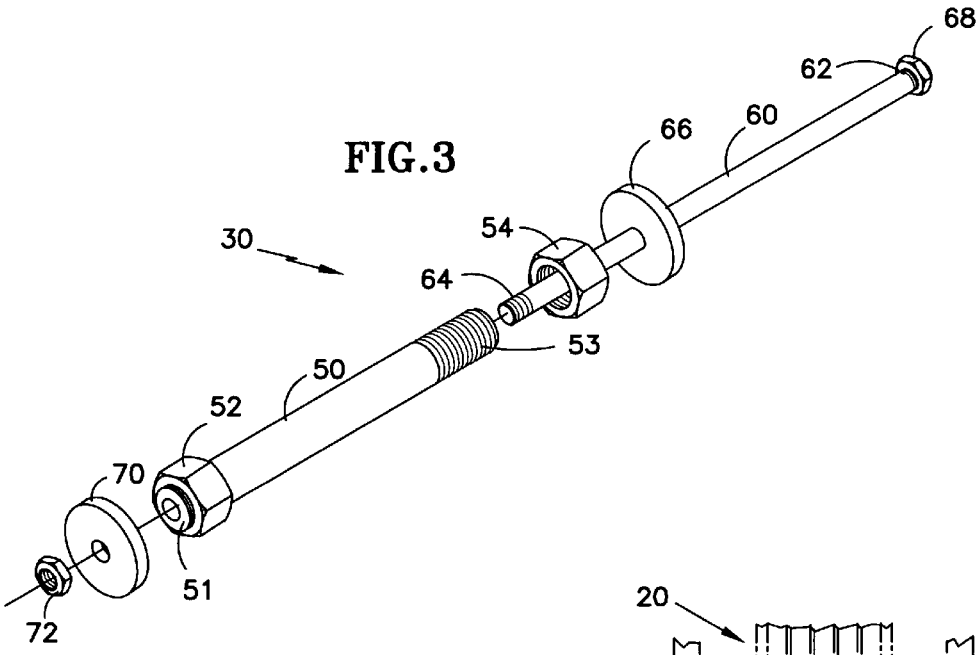
FIG. 3 is an exploded view of a rotatable hitch according to the preferred embodiment of the invention.
Figure 4:
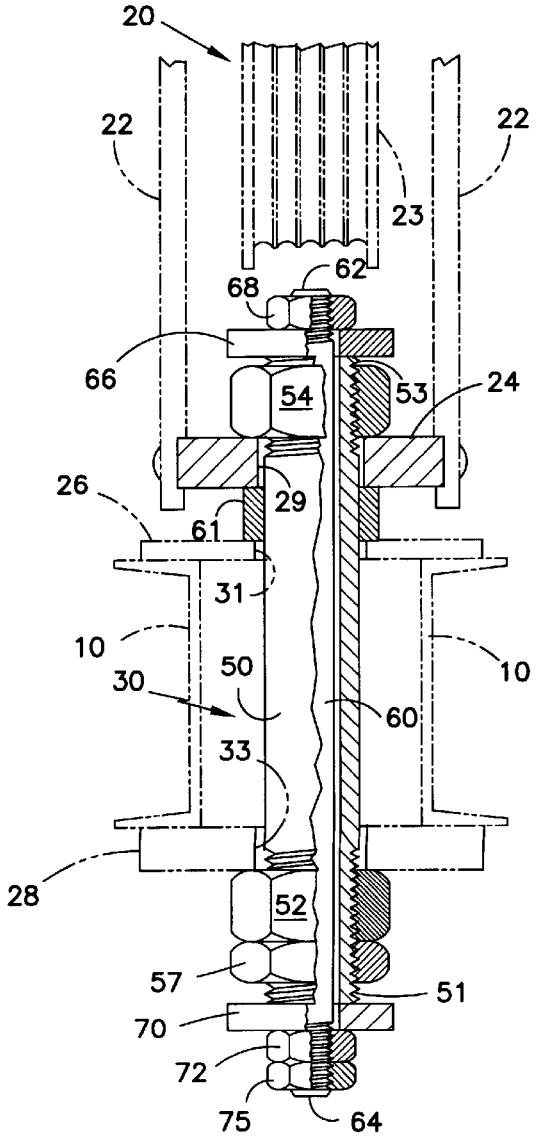
FIG. 4 is a cross-sectional view of the rotatable hitch of FIG. 1.

The hitch 30 will be described in more detail with reference to FIGS. 3 and 4. As is shown in FIGS. 3 and 4, the hitch 30 includes a hollow outer sleeve or bolt 50 which has a nut 52 for screw-threaded engagement at one free end 51 of the sleeve 50. A nut 54 is provided for screw-engagement with the other free end 53 of the sleeve 50. A connecting rod 60 is arranged within the hollow sleeve 50 and has ends 62 and 64 which project outwardly of the free ends 51, 53 of the sleeve 50. A large washer 66 is provided on the connecting rod 60 for location adjacent end 62. A small nut 68 is screw-threaded to the end 62. A second large washer 70 is provided for location on end 64 of the rod 60 which projects from the lower free end of the sleeve 50 as shown in FIG. 1 and a nut 72 is provided for screw-threaded engagement with the end 64 of the rod 60.

As shown with reference to FIG. 4, the connecting plate 24 is secured between the sheave brackets 22 and a rotatable sheave member 23 is rotatably mounted between the brackets 22 for receiving a cable (not shown) for allowing a lift car (not shown) to be raised and lowered in a lift well (not shown). The connecting plate 24 has a hole 29.

The cross-head channels 10 support upper and lower plates 26 and 28 as previously described. The plates 26 and 28 may be bolted to the channels 10 by bolts (not shown). The plates 26 and 28 have holes 31 and 33. The sleeve 50 is arranged through the holes 29, 31 and 33 with the ends 53 and 51 respectively projecting upwardly from the hole 29 as shown in FIG. 4 and down below the hole 33 as also shown in FIG. 4. After the sleeve 50 is located through the holes 29, 31 and 33, the large nut 54 is secured in place by screw-threading the nut 54 onto the end 53 of the sleeve 50. The nut 54 is of larger diameter than the hole 29 and therefore engages the plate 24 and couples the sleeve 50 to the lift sheave 20 by virtue of the abutment with the connecting plate 24. The nut 54 prevents the free end 53 of the sleeve 50 from being withdrawn through the hole 29.

The nut 52 is then screw-threaded onto the free end 51 of the sleeve 50 and abuts the lower plate 28. Once again, the nut 52 is of larger diameter than the hole 33 and couples the sleeve 50 to the cross-head channels 10 and prevents the free end 51 of the sleeve 50 from being withdrawn through the hole 33.

As shown in FIG. 4, a locknut 57 may also be located on the end 51 of the sleeve 50.

A spacer sleeve 61 may be provided between the connecting plate 24 and the top plate 26 and on the sleeve 50 for spacing the sheave 20 from the cross-head channels 10.

The sleeve 50 is rotatable in the holes 29, 31 and 33 so as to enable the sheave 20 to be easily rotated into a desired orientation during installation. During use of the lift system, the sheave is able to rotate slightly relative to the cross-head channels 10 if the load applied by the cable is sufficiently great, particularly at extreme ends of the lift movement.

The sleeve 50 and nuts 52 and 54 provide a primary connection of the sheave 20 to the cross-head channels 10.

The connecting rod 60 is arranged within the hollow sleeve 50 and the ends 64 and 62 project outwardly of the sleeve 50 as is clearly shown in FIG. 4. The connecting rod 60 may be a screw-threaded rod formed from high tensile material. Large washer 66 is arranged so that it abuts the end 53 of the hollow sleeve 50 and the washer 66 is retained in place by the small nut 68 which is screw-threaded onto the end 62 of the rod 60. The washer 70 is arranged on the other free end 64 of the connecting rod 60 and abuts the other end 51 of the sleeve 50. The washer 70 is located in place by the small nut 72 which is screw-threaded onto the free end 64 of the rod 60. A locking nut 75 may also be screw-threaded onto the free end 64 if desired. The washers 66 and 70 are dimensioned so they are larger than the holes 29 and 33 and therefore cannot be pulled through those holes.

The connecting rod 60 and the washer 66 and nut 68 and the washer 70 and nut 72 form a secondary connection of the sheave 20 to the cross-head channels 10. If the primary connection formed by the hollow sleeve is operating correctly, then no load is taken by the secondary connection formed by the connecting rod 60. in practice, the integrity of the primary coupling can be checked by simply determining whether the connecting rod 60 takes any load by gripping the connecting rod 60 in the vicinity of one of the nuts 68 or 72 and determining whether the connecting rod can be rotated or moved showing that it takes no load. The connecting rod 60 will only take load in the event that the primary connection formed by the hollow sleeve 50 fails for some reason.

Thus, should the primary connection formed by the hollow sleeve 50 and nuts 54 and 52 fail, then the sheave 20 will remain connected to the cross-head channels 10 by the secondary connection formed from the high tensile rod 60, the washers 66 and 70 and the small nuts 68 and 72.

The preferred embodiment of the invention therefore provides primary and secondary coupling of the rotatable hitch to the sheave 20 and cross-head channels 10: The hitch 30 shown in FIG. 2 is of the same structure as the hitch described in detail with reference to FIGS. 3 and 4. The only difference being that the hitch 30 is arranged as shown in FIG. 2 between the overhead beam 40 and the suspended sheave 20. In this arrangement, the connecting plate 46 supported by the brackets 42 replaces the bottom plate 28 and the hitch 30 is generally inverted from the position described with reference to FIGS. 1 and 4.

The preferred embodiment of the invention therefore provides a rotatable hitch and lift system which enable rotation of the hitch relative 30 to a frame member 10 as well as primary and secondary coupling of the hitch to the frame member and sheave.

Figure 5A:
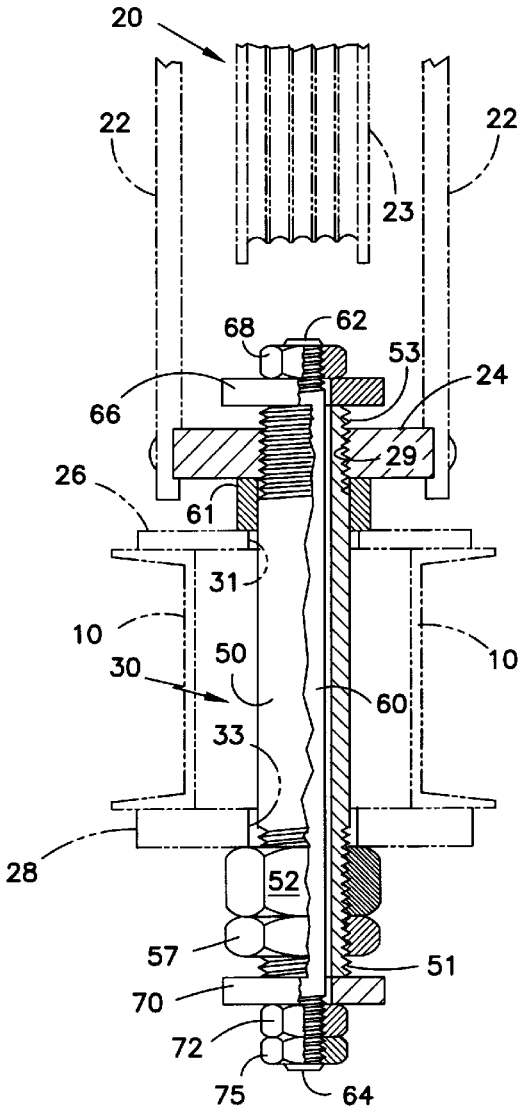
FIG. 5*a* is a cross-sectional view of a portion of the rotatable hitch of FIG. 1 showing a threaded connecting plate.

In another embodiment of the invention shown in FIG. 5A, the nut 54 can be done away with and the hollow sleeve 50 coupled to the plate 24 by providing a screw-thread in the hole 29 and a cooperating screw thread on the sleeve 50 engages the screw-thread in the hole 29. Thus, the hollow sleeve is screw-threaded onto the plate 24 to form a substantially rigid coupling of the sleeve 50 to the lift sheave 20.

Figure 5B:
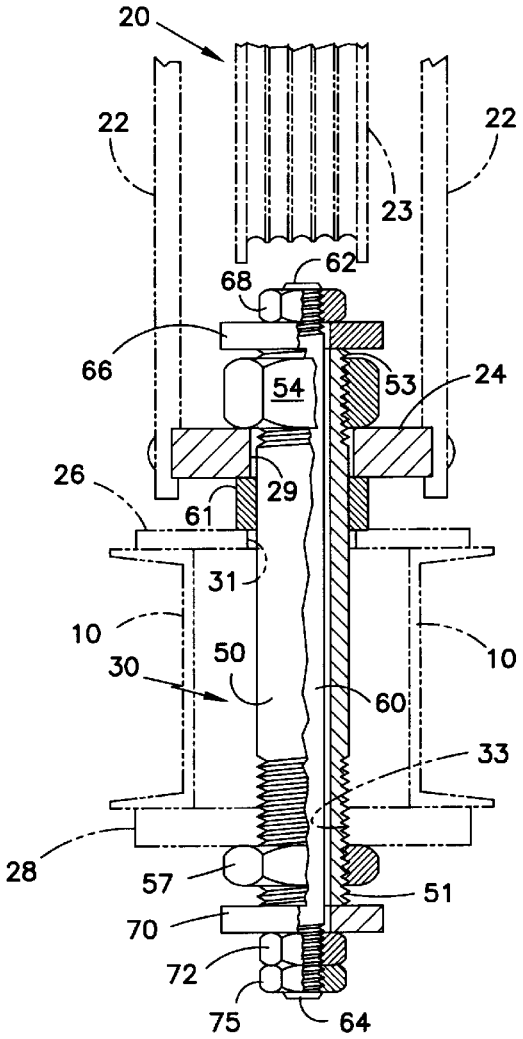
FIG. 5*b* is a cross-sectional view of a portion of the rotatable hitch of FIG. 1 showing a threaded lift sheave.

This arrangement does away with the nut 54 and therefore enables the height of the system to be reduced. Relative rotation of the sheave 20 relative to the cross-head channels 10 takes place by virtue of the ability of the sleeve 50 to rotate in the holes 31 and 33. In this arrangement, the sleeve 50 could also be tack welded to the plate 24. In yet a further embodiment, the screw-thread engagement between the sleeve 50 could be at the lower end of the arrangement shown in FIG. 4 by providing a screw-thread in the holes 33 as shown in FIG. 5B. In this arrangement, the upper end of the table hitch 30 would be as per the description of FIG. 4 to provide for the relative rotation of the cross-head channels 10 and the sheave 20.

Since modifications within the spirit and scope of the invention may readily be effected by persons skilled within the art, it is to be understood that this invention is not limited to the particular embodiments described by way of example hereinabove.

What is claimed is:

1. A rotatable hitch for securing a lift sheave to a frame element, including:

a hollow sleeve;

first coupling means attached to the hollow sleeve for coupling the hollow sleeve to the lift sheave;

second coupling means attached to the hollow sleeve for coupling the hollow sleeve to the frame element;

a connecting rod arranged within the hollow sleeve wherein the ends of the connecting rod extend beyond the ends of the hollow sleeve;

third coupling means attached to the connecting rod for coupling the connecting rod to the lift sheave;

fourth coupling means attached to the connecting rod for coupling the connecting rod to the frame element; and the hollow sleeve being rotatable relative to at least one of the frame element and/or lift sheave when installed between the lift sheave and the frame element to enable rotation of the lift sheave relative to the frame element.

2. The hitch of claim 1, wherein the first and second coupling means comprise nuts on the hollow sleeve for engaging an abutment member on the lift sheave and frame element respectively, the nuts on the hollow sleeve engaging the abutment members and abutting the abutment members so as to secure the hitch to the lift sheave and the frame element.

3. The hitch of claim 1, wherein the third and fourth coupling means comprise nuts on the connecting rod, the nuts on the connecting rod engaging a retaining plate and sandwiching the retaining plate between the respective nut on the connecting rod and respective ends of the hollow sleeve.

4. The hitch of claim 3, wherein the retaining plates comprise washers.

5. The hitch of claim 1, wherein the lift sheave includes a pair of brackets which support a connecting plate, the connecting plate having a hole and the hollow sleeve passing through the hole to pivotally couple the lift sheave to the frame element.

6. The hitch of claim 1, wherein the first coupling means comprises a screw-thread on at least one of the lift sheave or frame element and a cooperating screw-thread on the hollow sleeve for engaging the screw-thread on said at least one of the lift sheave or frame element.

7. A lift system including:

a lift sheave having a support member;

a frame element having a support member;

a hole in at least one of the support members of the lift sheave or frame element;

a hollow sleeve extending through the hole in the support member so that a free end of the hollow sleeve projects through the hole;

a first coupling member on the free end of the hollow sleeve for preventing the hollow sleeve from being withdrawn through the hole and for coupling the sleeve to the lift sheave or frame element which has the hole;

a second coupling member on the other free end of the hollow sleeve for coupling the sleeve to the other of the lift sheave or frame element;

the sleeve being rotatable in the hole so as to enable the lift sheave to rotate relative to the frame element;

a connecting rod within the hollow sleeve;

third coupling means at one end of the connecting rod for coupling the connecting rod to the lift sheave; and fourth coupling means at the other end of the connecting rod for coupling the connecting rod to the frame element.

8. The lift system of claim 7, wherein the first and second retaining members comprise nuts on the hollow sleeve for engaging the abutment members on the lift sheave and frame element respectively, the nuts on the hollow sleeve abutting the abutment members so as to connect the hitch to the lift sheave and the frame element.

9. The lift system of claim 7, wherein the third and fourth retaining members comprise nuts on the connecting rod, the nuts on the connecting rods engaging respective retaining plates and sandwiching the retaining plate between the respective nut on the connecting rod and respective ends of the hollow sleeve.

10. The lift system of claim 9, wherein the retaining plates comprise washers.

11. The lift system of claim 7, wherein the lift sheave includes lift sheave brackets and the abutment member of the lift sheave comprises a connecting plate connected between the lift sheave brackets.

12. The lift system of claim 7, wherein the abutment member of the frame element comprises a plate connected to the frame element.

13. The lift system of claim 7, wherein one free end of the hollow sleeve is secured to the support member of the other of the lift sheave or frame element so as to be a substantially rigid connection.

14. The lift system of claim 13, wherein the substantially rigid connection is formed by a screw-thread in a hole in the support member and a cooperating screw thread on the free end of the hollow sleeve so that the hollow sleeve is screwed into the hole to couple the hollow sleeve to the support member and therefore the other of the lift sheave or frame element.

* * * * *